United States Patent [19]

Mitchell

[11] 4,142,542

[45] Mar. 6, 1979

[54] PIPELINE BUFFER HYDROCARBON FROM CATALYTIC CRACKER EFFLUENT

[75] Inventor: Norris W. Mitchell, Sweeny, Tex.

[73] Assignee: Phillips Petroleum Company, Bartlesville, Okla.

[21] Appl. No.: 862,064

[22] Filed: Dec. 19, 1977

[51] Int. Cl.[2] ..... E03B 1/00; F17D 1/00

[52] U.S. Cl. ..... 137/1; 208/370

[58] Field of Search ..... 208/370; 137/1

[56] References Cited

U.S. PATENT DOCUMENTS

| | | | |
|---|---|---|---|
| 2,657,700 | 11/1953 | Ray | 137/93 |
| 2,832,363 | 4/1958 | Wood et al. | 137/1 |
| 2,920,039 | 1/1960 | Miller | 208/361 |
| 2,953,146 | 9/1960 | Gordon | 137/1 |
| 3,095,888 | 7/1963 | Kline et al. | 137/10 |
| 3,383,308 | 5/1968 | Wickham et al. | 208/353 |
| 3,590,834 | 7/1971 | Henry | 137/1 |
| 3,648,713 | 3/1972 | Varirogs | 137/1 |
| 4,003,822 | 1/1977 | Jo | 208/102 |

*Primary Examiner*—C. Davis

[57] ABSTRACT

In the fractionation of hydrocarbon vapors from a catalytic cracking of a hydrocarbon oil producing cracked vapors including gases, cracked gasoline fraction, a light cycle oil and heavier, a pump-around fraction intermediate the gasoline fraction and said light cycle oil is recovered, stripped of gasoline constituents and as necessary treated for removal of sulfur compounds and then used to separate in a pipeline simultaneously flowing therein a gasoline and a distillate having a flash point of at least about 125° F. Use of the recovered fraction permits the separation during transportaton in the pipeline while avoiding significantly changing the octane of the gasoline or the flash point of the distillate whether there be blending within the pipeline of the buffered fraction with the gasoline and/or with the distillate or at the receiving terminal in making the cut between the gasoline and the distillate.

3 Claims, 1 Drawing Figure

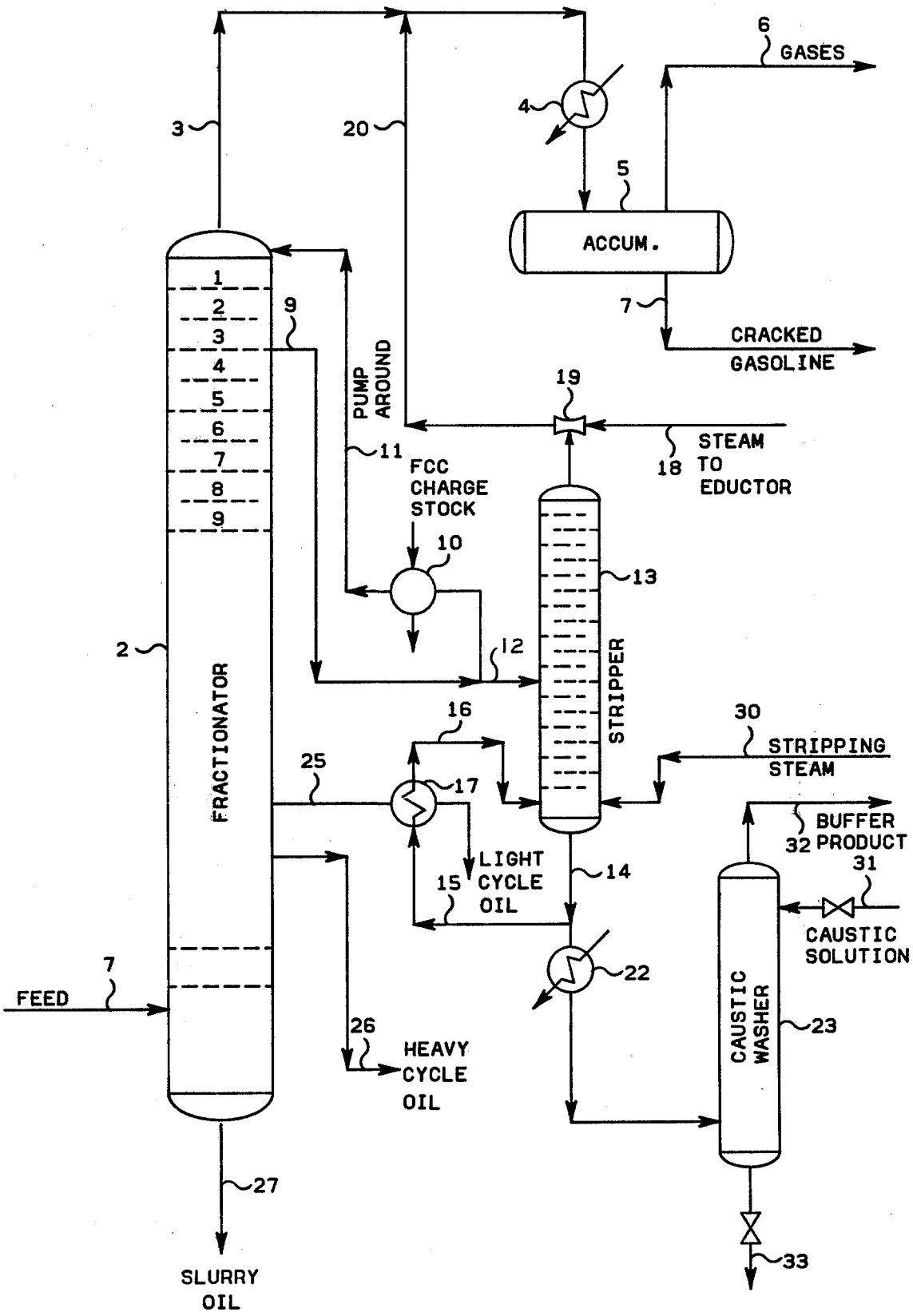
6
GASES
4
3
20
5
ACCUM.
7
CRACKED
GASOLINE
1
2
3
4
5
6
7
8
9
9
PUMP
AROUND
19
11
FCC
CHARGE
STOCK
18
STEAM
TO
EDUCTOR
10
13
2
12
FRACTIONATOR
STRIPPER
16
30
STRIPPING
STEAM
25
17
BUFFER
32 PRODUCT
31
LIGHT
CYCLE
OIL
15
14
CAUSTIC
SOLUTION
7
22
FEED
CAUSTIC
WASHER
23
26
HEAVY
CYCLE
OIL
27
33
SLURRY
OIL

PIPELINE BUFFER HYDROCARBON FROM CATALYTIC CRACKER EFFLUENT

This invention relates to the transportation of hydrocarbon gasolines and distillates. In one of its aspects the invention relates to the transportation by pipeline of a gasoline and a distillate which are simultaneously in said pipeline. More specifically in one of its aspects, the invention relates to the provision and use of a so-called "buffer" hydrocarbon material to separate a distillate and a gasoline simultaneously flowing in a pipeline.

In one of its concepts, the invention provides a buffer liquid derived from the fractionation of cracked vapors obtained upon catalytic cracking of a hydrocarbon oil to produce a cracked gasoline fraction and a light cycle oil fraction in the production of which there is effected a fractionation in which there is obtained a pump-around fraction from fractionation which is higher boiling than gasoline which is yielded and lower boiling than a light cycle oil and which contains gasoline constituents which are stripped therefrom and employing the stripped fraction to separate or to act as a buffer between a gasoline and a distillate which are being simultaneously transported through a pipeline wherein the distillate follows the gasoline or vice versa. In another of its concepts, the invention provides for vacuum stripping said pump-around fraction in presence of steam. If a further concept of the invention the stripped fraction is treated to remove sulfur in sulfur compounds as may be necessary or desired.

Presently, there is being used as a buffer between gasoline and distillates successfully transported through a pipeline a so-called heavy alkylate. This heavy alkylate is produced in a sophisticated, expensive manner and is very desirable as a component of various fuels or for use as special isoparaffinic hydrocarbon. Moreover, to the extent that the production of heavy alkylate can be minimized in favor of a lighter alkylate the lighter alkylate can be put to uses which are more effective in a time of emergency as when there is a shortage of motor fuel or raw material to produce alkylate-derived products, e.g., detergents. I have conceived that as a replacement for heavy alkylates, now used, a source of buffer, upon suitable treatment, can be the so-called pump-around liquid herein described. This hydrocarbon liquid normally has a distribution of constituent compounds therein such that upon stripping in a suitable manner as under vacuum and with steam there is produced a liquid hydrocarbon fraction which will not adversely affect the octane of gasoline nor significantly lower the flash point of a distillate when partially blended with each as in the pipeline or at a receiving terminal.

It is an object of this invention to produce a buffer suitable for the separation in a pipeline while being transported therein simultaneously of a gasoline and a distillate. It is another object of the invention to produce such a buffer which will not adversely significantly affect either the octane or the gasoline nor the flash point of the distillate when partially blended with each as in the pipeline or at a receiving terminal. It is a further object of the invention to produce a buffer, as herein described, suitable to replace currently used heavy alkylate.

Other aspects, concepts, objects and the several advantages of the invention are apparent from a study of this disclosure, the drawing, and the appended claims.

According to the present invention, a pump-around fraction taken from a fractionator in which cracked vapors obtained from a catalytic cracking of a hydrocarbon oil to produce gasoline, light cycle oil and heavier are fractionated, is stripped under relatively low pressure and high temperature and in presence of added steam to remove therefrom gasoline constituents to produce a buffer fluid suited for separating in a pipeline in which there are being transported simultaneously a gasoline and a distillate having a safe flash point.

Also according to the invention, the stripped fluid is treated as may be desired to remove sulfur and sulfur compounds therefrom.

Still further according to the invention, the obtained, treated pump-around fraction which is higher boiling than gasoline and which has a boiling range lower than said light cycle oil is injected into a pipeline to follow a gasoline and to be followed by a distillate or is injected to follow a distillate to be followed by a gasoline.

The use of the fraction or buffer, of the invention, permits a convenient cutting of the products from the pipeline without there being undue concern that the octane number of the gasoline shall have been significantly lowered or the flash point of the distillate shall have been significantly lowered in the sense of performance of the gasoline as in an engine and the safety of the distillate, respectively. This will be so even in the case of blending of some of the buffer with either the gasoline or the distillate or both while transported for a time to a substantial distance in the pipeline.

U.S. Pat. Nos. 3,383,308 and 4,003,822 issued May 14, 1968, and Jan. 18, 1977, illustrate pump around streams in the fractionation of hydrocarbons derived from catalytic cracking for the production of gasoline. The latter patent illustrates generally the stripping of a heavy naphtha. The disclosures of these patents are incorporated herein by reference.

According to the present invention, as earlier noted, the pump-around fluid is subjected to steam stripping at relatively low pressure and high temperature.

To further set forth and to illustrate the obtaining of the buffer of the invention reference is now made to the drawing.

Hydrocarbon vapors from catalytic cracking are passed by 1 into fractionator 2. Overhead from the fractionator containing gases and gasoline is passed by 3 through condenser 4 into accumulator-gas separator 5 from which gases are removed overhead at 6 and cracked gasoline is removed at 7.

In fractionator 2 usual operation is performed. While said operation is being performed there will be removed from a tray below the top tray in the fractionator as at 9 a pump-around fluid which after some cooling in heat exchanger 10 is pumped into the fractionator by 11, at a locus above the withdrawal, to be there used as reflux.

According to the invention some of the liquid in 9 is passed by 12 to stripper 13. The stripper acts to strip low boiling hydrocarbons from the pump-around fluid with the aid of relatively low pressure and steam at high temperature, yielding the buffer of the invention at 14. Some of the stripper bottoms can be cycled by 15 and 16 through heat exchanger 17 to supply additional heat to the stripper 13. Steam is passed by 18 into eductor 19 and by 20 to 3 thus creating a relatively low pressure and removing gasoline constituents from the pump-around oil to produce the buffer of the invention. The gasoline constituents are the light hydrocarbons in stream 12 and would cause the buffer to have too low of a flash point if these were not removed therefrom. Steam 30 is added into the bottom of stripper 13 to assist in removal of light hydrocarbon components from the liquid feed 12 charged to stripper 13.

As necessary the yield from the stripper at 14 is passed by way of a cooler 22 to caustic washer 23 for removal of sulfur and sulfur compounds. Final buffer product is recovered at 32. Caustic solution is added at 31, as required, and removal of used caustic is at 33, as required.

Light cycle oil is taken from the fractionator at 25. A heavy cycle oil is taken from the fractionator at 26. A slurry oil is removed from the fractionator at 27.

By way of further illustration of the invention and the obtaining of the buffer hydrocarbon liquid thereof the following calculated operation is given.

| | |
|---|---|
| I. Operating Conditions: | |
| (2) Fractionation Conditions: | |
| Pressure, psig., | 12.4 |
| Temperatures, ° F., | |
| (1) Feed vapor, | 1000 |
| (27) Slurry oil bottoms, | 680 |
| (3) Overhead vapor, | 284 |
| (9) Buffer stock removal locus, | 325 |
| (5) Overhead Accumulator Conditions: | |
| Pressure, psig., | 9.0 |
| Temperature, ° F., | 115 |
| (13) Buffer Producing Stripping Conditions: | |
| Pressure, psig., | 13 |
| Temperature, ° F., | |
| Top, | 325 |
| Bottom, | 320 |
| (23) Caustic Washer Conditions: | |
| Pressure, psig., | 10 |
| Temperature, ° F., | 110 |
| II. Process Flows and Conditions: | |
| (1) Vapor feed (measured as liquid), barrels/hr., | 1000[a] |
| Temperature, ° F., | 1000 |
| (27) Slurry oil, barrels/hr., | 300 |
| Temperature, ° F., | 680 |
| (26) Heavy cycle oil, barrels/hr., | 0 |
| (25) Light cycle oil, barrels/hr., | 525 |
| Temperature, ° F., | 410 |
| API at 60° F., | 35 |
| (6) Light hydrocarbon gases, SCF/hr., | 740,000 |
| (7) Gasoline liquid, barrels/hr., | 450 |
| Boiling range, ° F., | 90 to 400 |
| API at 60° F., | 51 |
| Research Octane, clear | 92 |
| (12) Buffer stock to stripper (13), barrels/hr., | 10 |
| Boiling range, ° F., | 200 to 500 |
| Temperature, ° F., | 325 |
| Tag closed cup flash, ° F., | low |
| Weight percent sulfur, | low |
| (30) Steam to stripper (13), pounds/hr., | 1000 |
| Temperature, ° F., | 500 |
| (18) Steam to eductor (19), pounds/hr., | 50 |
| Temperature, ° F., | 500 |
| (31) Aqueous caustic to stripper (23), barrels/hr., | 5 |
| Temperature, ° F., | 110 |
| Weight percent NaOH | 20 |
| (32) Buffer product, barrels/hr., | 10 |
| Boiling range, ° F., | 340 to 500 |
| Tag closed cup flash, ° F., | 110 |
| Research Octane, clear, | 88 |
| Weight percent sulfur, | nil |

[a]The feed is the hydrocarbon produced from conventional fluid catalytic cracking of a virgin gas oil produced by "atmospheric" distillation of crude oil. The hydrocarbon charged to catalytic cracking can include any conventional gas oil, topped crude oil, and the like, however.

As can be seen from the information above, the final "buffer" product 32 can be used between gasoline and distillates in a pipeline since the flash point of the "buffer" is sufficiently high and the octane number is sufficiently high so as to not adversely lower the flash point of a distillate nor lower the octane of a gasoline when the "buffer" becomes blended therewith.

The aqueous caustic strength in 23 usually is between about 15 and about 25 weight percent NaOH.

The quantity of buffer which will become blended with the gasoline and/or distillate will depend upon the quantity of each of the several fluids being moved. Obviously, the larger the amount of gasoline and/or distillate with respect to the slug of buffer, the less effect blending of the slug fluid or buffer with either the gasoline or distillate will have upon these products. Time in the pipeline and distance of transportation as well as other factors known in the art will tend to cause some blending at the interface between the buffer and the gasoline on the one hand and the buffer and the distillate on the other.

The distillate transported in the pipeline can be a kerosene, heating oil, stove oil, diesel fuel, or a light cycle oil. One skilled in the art in possession of this disclosure having studied the same will be able to determine what are the distillates which can be separated from gasoline by using the buffer material of this invention.

Reasonable variation and modification are possible within the foregoind disclosure, drawing, and the appended claims to the invention the essence of which is that a pump-around fluid obtained in the fractionation of vapors obtained from the catalytic cracking of a hydrocarbon oil to produce gasoline, etc., is stripped under a relatively low pressure at high temperature, and with aid of steam to produce a desirable substitute for heavy alkylate used as a buffer between a gasoline and a distillate in a pipeline without significantly lowering the octane value of the gasoline nor lowering significantly the flash point of the distillate when blended therewith during transportation in the pipeline and/or at the receiving terminal.

What is claimed is:

1. In the shipping or transportation by pipeline of a gasoline and a distillate having a flash point of at least about 125° F. the use as a buffer therebetween in the pipeline of a liquid hydrocarbon obtained by fractionating in a fractionation zone a stream of cracked hydrocarbon vapors, obtained upon cracking a hydrocarbon oil in the presence of a catalyst to yield said vapors to include gases, a cracked gasoline fraction and a light cycle oil which can be fractionated from said vapors in said zone, fractionating from said vapor in said zone a fraction containing said gasoline fraction as an overhead from said zone, withdrawing from said zone a second fraction higher boiling than said gasoline fraction but lower boiling than said light cycle oil, passing said second fraction to a stripping zone, in said stripping zone stripping said second fraction under low pressure and high temperature and with the aid of steam to remove therefrom constituents boiling in the gasoline fraction boiling range, and when sulfur or sulfur compounds are present in undesirable amounts contacting said now-stripped fraction with a sulfur removal treating agent, recovering said thus treated second fraction and injecting the same between a volume of gasoline and a volume of distillate being shipped in said pipeline.

2. The production of a liquid hydrocarbon buffer for use in pipeline transportation of a gasoline and a distillate to keep them apart when transported successfully in said pipeline which comprises fractionating in a fractionation zone a stream of cracked hydrocarbon vapors, obtained upon cracking a hydrocarbon oil in the presence of a catalyst to yield said vapors to include a cracked gasoline fraction and a light cycle oil which can be fractionated from said vapors in said zone, fractionating from said vapors in said zone a fraction containing said gasoline fraction as an overhead from said zone, withdrawing from said zone a second fraction higher boiling than said gasoline fraction but lower boiling than said light cycle oil, passing said second fraction to a stripping zone, in said stripping zone stripping said fraction under low pressure and high temperature and with the aid of steam to remove therefrom constituents boiling in a gasoline fraction boiling range and recovering said stripped fraction as a buffer for use in pipeline transportation of a gasoline and a distillate having a flash point of at least about 125° F.

3. The production of claim 2 wherein the stripped second fraction is treated to remove sulfur and sulfur compounds therefrom.

* * * * *